United States Patent [19]

Sullivan et al.

[11] 4,416,651

[45] Nov. 22, 1983

[54] ENVELOPE GUMMER CYLINDER CLUTCH AND BRAKE

[75] Inventors: John Sullivan, San Jose; Harold R. Lillibridge, Burlingame, both of Calif.

[73] Assignee: Champion International Corporation, Stamford, Conn.

[21] Appl. No.: 288,522

[22] Filed: Jul. 30, 1981

[51] Int. Cl.[3] ..... B31B 1/62

[52] U.S. Cl. ..... 493/12; 118/681; 493/266

[58] Field of Search ..... 493/12, 27, 29, 266; 118/681, 680, 669, 212; 192/14, 18 B

[56] References Cited

U.S. PATENT DOCUMENTS

| | | | |
|---|---|---|---|
| 2,000,325 | 5/1935 | Ford et al. | 118/212 X |
| 2,134,379 | 10/1938 | Sauerman | 493/12 X |
| 2,455,900 | 12/1948 | Yardeny et al. | 192/14 |
| 2,776,224 | 1/1957 | Cote | 493/12 X |
| 3,030,915 | 4/1962 | Shannon | 118/212 X |
| 3,687,252 | 8/1972 | Krull | 192/14 X |
| 4,055,111 | 10/1977 | Howatt | 493/12 X |

FOREIGN PATENT DOCUMENTS

| | | | |
|---|---|---|---|
| 2647437 | 12/1977 | Fed. Rep. of Germany | 493/12 |

*Primary Examiner*—James F. Coan
*Attorney, Agent, or Firm*—Evelyn M. Sommer

[57] ABSTRACT

Apparatus for applying gum to spaced portions of an envelope is provided with means for sensing the absence of an envelope on a conveyor belt feeding the envelopes to the gummer apparatus. In response to sensing the absence of an envelope on the conveyor belt, a gummer cylinder containing spaced gummer pads for applying gum to the flap and body of the envelope is precluded from rotating by disengagement of a clutch between the gummer cylinder and its drive and simultaneous contact of a brake with the cylinder.

11 Claims, 3 Drawing Figures

ENVELOPE GUMMER CYLINDER CLUTCH AND BRAKE

BACKGROUND OF THE INVENTION

1. Field of the Invention

This invention relates to apparatus for applying gum to spaced locations on an envelope blank subsequent to its folding into a finished envelope, and more particularly, such an apparatus including means for sensing the absence of an envelope fed to the gumming apparatus so that the gumming apparatus is reduced inactive upon the sensing of such a condition to preclude gum from being applied to the envelope blank feed means, rather than the envelope.

2. Description Of The Prior Art

Blanks from which envelopes are formed are required to go through a gluing operation subsequent to folding and forming of the envelope blank. The gluing operation deposits gum or adhesive on the flap of the envelope and a spaced portion adjacent thereto on the body of the envelope and then dried. When the envelope is used, the flap is moistened and folded so that it will adhere to the gum deposited and dried on the body portion of the envelope.

Normally, the gumming apparatus comprises an endless belt for feeding the folded envelope blanks to a gum applying cylinder. The envelopes are each fed with their flap opened and parallel to the main body which the flap will overlie when closed. Gum is applied by a pair of spaced gummer pads on the circumference of a rotating cylinder at a gummer station. Rotation of the cylinder is controlled so that gum is applied to the flap and main body portion of the folded envelope blank as the blank on the endless belt passes beneath the gummer cylinder.

This is accomlished by driving the gummer cylinder with a gripper belt entrained about a pulley connected to the gummer cylinder at a rate will assure that the gummer pads on the cylinder are over the feed belt when the envelope blank passes therebeneath. This requires that the linear spacing of the envelopes on the feed belt be correlated to the rotational velocity of the gummer cylinder. The gripper belt is positioned above the feed belt so that as a gum is applied to the envelope, the gripper will firmly hold the lower portion of an envelope to the feed belt and then will advance it through subsequent operations performed by the envelope apparatus, such as drying the applied gum. The gripper belt will always drive the pulley connected to the gummer cylinder to apply gum to spaced locations on the envelope blank such as the flap and a spaced portion of the body of the envelope blank. If for any reason an envelope blank is not present as the gummer cylinder completes its circular movement, glue will be applied to the feed belt rather than the envelope blank. This may cause the feed belt to adhere to the gummer cylinder as it passes therebeneath or other portions of the envelope forming apparatus as well as adhereing to subsequent blanks fed on the belt. The apparatus must be stopped and the belt cleaned before the apparatus can be continued to be operated.

In order to avoid such a problem, the prior art has suggested the use of a first photocell for detecting the presence of the envelope blank on the feed belt and a second photocell for monitoring the angular position of the gummer cylinder and producing a second output signal when the gummer cylinder is in proper position to apply gum to the next envelope blank as it passes the gummer cylinder. Means are coupled to the first or second photocell outputs so that in response to a signal that an envelope blank is missing from the feed belt, the gummer cylinder is precluded from applying gum to the feed belt. Such a means is disclosed in the application of David L. Gingerich, Ser. No. 950,626 filed Oct. 12, 1978, entitlted "Envelope Forming Machine" and assigned to the same assignee as the assignee of the present invention. In this application, the means for incapacitating the gum applying cylinder includes means responsive to the absence of a combined signal from the first and second photocells for moving the feed belt away from the gum applying cylinder.

This solution is awkward in that a separate mechanism must be provided for moving the feed away from the gum applying element. The present invention offers an alternate solution for incapacitating the gummer cylinder in that the gum applying cylinder is provided with gum applying pads extending along its circumference for contact with the envelope blank which are precluded from rotating into contact with the feed belt upon the sensing of the absence of an envelope blank to be gummed on the feed belt.

SUMMARY OF THE INVENTION

In accordance with the present invention, apparatus for applying gum to spaced portions of an envelope blank is provided with means for sensing the absence of an envelope on a conveyor belt feeding the envelope blanks to the gummer apparatus. Upon sensing the absence of an envelope blank on the conveyor belt, a gummer cylinder containing spaced gummer pads for applying gum to the flap and body of the folded envelope blank is precluded from rotating.

An electric brake assembly has an armature in driving engagement with the gummer cylinder to rotate the same. The armature is also connected to one of two single-toothed clutch plates. The other clutch plate is connected to a pulley entraining an endless drive belt. Upon receipt of an electric signal by the brake assembly in response to sensing the absence of an envelope blank on the feed belt the armature is electrically retracted disengaging the clutch plates and the gummer cylinder from its driving connection with the drive belt, thus precluding rotation of the gummer cylinder.

Upon sensing of a subsequent envelope blank in its proper position on the feed belt the brake assembly is deactivated and a spring returns the armature of the brake assembly to its initial position causing the spaced clutch plates to engage, allowing the gummer cylinder to be reconnected to the drive and rotate in timed sequence to movement of the belt feeding the envelope blanks to the gummer cylinder so that the gummer pads can engage the spaced flap and body portion of the envelope of apply gum thereto.

BRIEF DESCRIPTION OF THE DRAWINGS

Further objects and advantages of the invention will become apparent from the following description of claims, and from the accompanying drawings, wherein:

DETAILED DESCRIPTION OF THE PREFERRED EMBODIMENT

Figure 1:
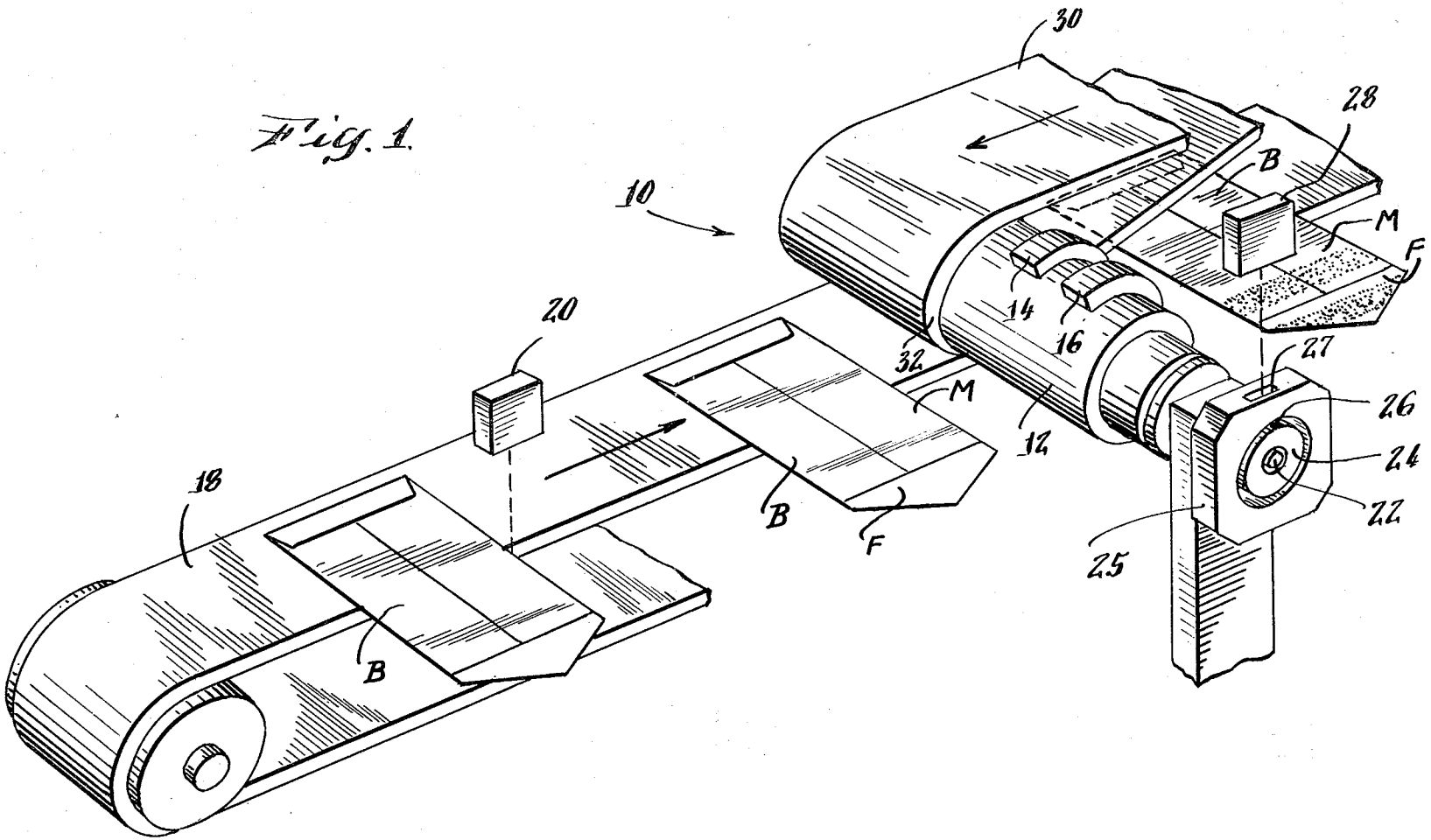
FIG. 1 is a perspective view of the envelope gummer cylinder clutch and brake apparatus of the present invention positioned over an envelope feed belt.
Figure 2:
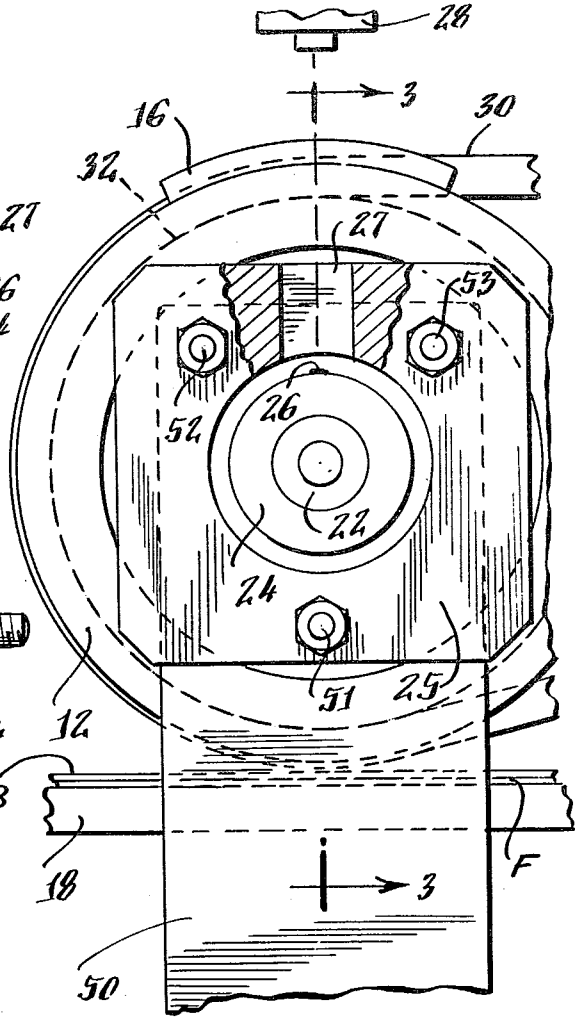
FIG. 2 is a side view in elevation of the envelope gummer cylinder clutch and brake apparatus of FIG. 1.

Referring now to the drawings in detail, wherein like numerals indicate like elements throughout the several views, FIG. 1 illustrates envelope gumming apparatus 10 including a gummer cylinder 12 having a pair of arcuate spaced gum applying pads 14 and 16 extending along a portion of the circumference of the cylinder 12. The length of the arcuate segment of each pad 14 and 16 is determined by the spacing between envelope blanks B which are fed to the gummer cylinder 12 on an endless feed belt 18. The blanks B are fed with the flap portion F of each envelope blank B opened relative to the main body portion M of the folded blank so that upon rotation of the cylinder the pad 16 can apply gum or adhesive to the flap F while the pad 14 can apply gum or adhesive at a spaced location on the main body portion M of the envelope blank B. Thereafter, the gum applied to blank B is dried and when the envelope is used, the flap F can be secured to the main body portion M upon folding them into juxtaposition after the gum is moistened. By virtue of forming the pads 14 and 16 of a finite length along the circumference of gummer cylinder 12, the pads will only contact the envelope blank B.

In order to assure the gummer pads 14, 16 only contact each envelope blank B, a sensing head 20 comprising a photocell or the like senses the leading edge of the envelope blank B downstream from the gummer cylinder 12. The gummer cylinder 12 is mounted for rotation through spaced bearings 19 upon a shaft 22. Shaft 22 has a cam 24 fixed to it on one end of the shaft 22. The cam 24 is mounted for rotation in a housing 25 fixed to a stationary frame 50. The housing 25 includes an opening 27 for periodically exposing index mark 26 on the cam circumference which is adapted to be sensed by a second sensing head or photocell 28 when the transverse center of the arcuate segment of each gummer pad 14, 16 is at a twelve o'clock position on the cylinder circumference or when the index mark 26 on cam 24 corresponds with the center of slot 27. Upon sensing of the index mark 26 by photocell 28 and the receipt of a signal from sensing head or photocell 28 and the receipt of a signal from sensing head or photocell 20 sensing the leading edge of an envelope blank B downstream from the gummer cylinder 12, circuitry well known to one with ordinary skill in the art, e.g., logic circuitry, is employed to generate a signal to the drive for the gummer cylinder to enable it to be rotated in timed sequence to the movement of the leading edge of the envelope blank B sensed by sensing head 20 so that when the blank B is beneath the cylinder 12, the gum applying pads 14 and 16 will contact the flap F and main body portion M the envelope blank B to apply gum thereto.

The gummer cylinder 12 is driven by an endless gripper belt 30 entrained about a pulley 32 fixed by a set screw 31 or the like to shaft 22. Movement of gripper belt 30 not only causes rotation of shaft 22 and cam 24, but its lower run also serves in conjunction with the upper rum of the feed belt 18 to grip the lower end of the main body portion M of the envelope blank B below its gummed area in conjunction with the feed belt 18 to hold the envelope securely as gum is applied to it. The gripper belt pulley 32 is also fixed to a clutch plate 34 of a single-tooth clutch mechanism 36 housed within the interior of gummer shaft 22 adjacent the gripper belt pulley 32. Single-tooth clutch mechanism 36 also includes a second clutch plate 38 having a tooth 39 adapted to engage a notch in the clutch plate 34 so that the two can move in unison when forced towards each other. The second clutch plates 38 is also mounted on shaft 22 but is adapted to move laterally with respect to the clutch plate 34 on the shaft 22 and is fixed at its upper end to an armature assembly 40 of an electric brake assembly 42. Armature assembly 40 includes an arm 44 connected to the transversing clutch plate 38. On or more compression springs 46 are wound about the arm 44 between the second clutch plate 38 of the single-tooth clutch mechanism 36 and a fixed stop 48 on the cylinder 12. Arm 44 also extends through a pair of spaced bushings 45, 47 seated in a bore 49 in gummer cylinder 12. Thereafter, rotation of arm 44 about shaft 22 will cause rotation of cylinder 12 and bearings 19 about shaft 22. The armature assembly 40 of electric brake assembly 42 includes a pair of spaced discs lined with friction-generating material. One of the discs is connected to and rotates with arm 44, while the other disc is stationary and spaced from the first disc. This second disc forms a part of the otherwise stationary brake assembly 42. Upon activation of the brake assembly 42 by receipt of an electrical signal, a solenoid or electromagnet comprising a portion of the armature assembly 40 of the brake 42 causes the first disc and arm 44 to be retracted towards and into contact with the friction material on the second disc and disengages the clutch plates 34 and 38 of single-tooth clutch mechanism 36. When the clutch plates 34 and 38 are separated, gummer cylinder 12 is disconnected from pulley 32. However, when the brake assembly 42 is deactivated, the spring 46 causes the arm 44 to reextend and the clutch plates 34, 38 to interengage. Rotation of pulley 32 is then transmitted through clutch plates 34, 38 to arm 44 and the first disc of the armature assembly 40. Rotation of arm 44 about shaft 22 causes rotation of bearings 19 and gummer cylinder 12 with shaft 22. Upon reactivation of the brake assembly 42, the arm 44 is again retracted, disengaging the clutch plates 34, 38 and the driving connection between pulley 32 and gummer cylinder 12. Upon retraction of arm 44 and the first disc of the armature assembly 40, any tendency of gummer cylinder 12 to continue to rotate due to the inertial mass of the cylinder is stopped by engagement of the friction surfaces of the first and second discs of the armature assembly 40. The spacing between these discs can be adjusted by rotating three lugs 51, 52 and 53 connected at one end to the second disc of the armature assembly 40. The opposite end of each lug 51, 52 and 53 is received in a nut 54 abutting stationary cam housing 25, whereby rotation of the nuts 54 will cause linear movement of the lugs and the second disc. A gauge plate 55 is fixed to frame 50 and is used to guage the relative movement of the discs of the armature assembly, by gauging the distance of relative movement of the gauge plates 55 and brake assembly 42 upon rotation of lugs 51, 52 and 53.

The function of the clutch mechanism 36 and brake mechanism 42 is to stop the gummer cylinder 22 in approximately the same position, e.g., to allow the gummer pads 14 and 16 to be in an approximate twelve o'clock position each time the gummer cylinder 22 is stopped, and to stop rotation of the gummer cylinder upon sensing the absence of an envelope blank B on feed belt 18. This enables the proper timing sequence to occur between rotation of the gummer cylinder and gummer pads 14 and 16 with the arrival of the envelope blank B to be gummed therebeneath. The gripper belt 30, gripper belt pulley 32 and feed belt 18 are operative at all times, but not the gummer cylinder 22.

Figure 3:
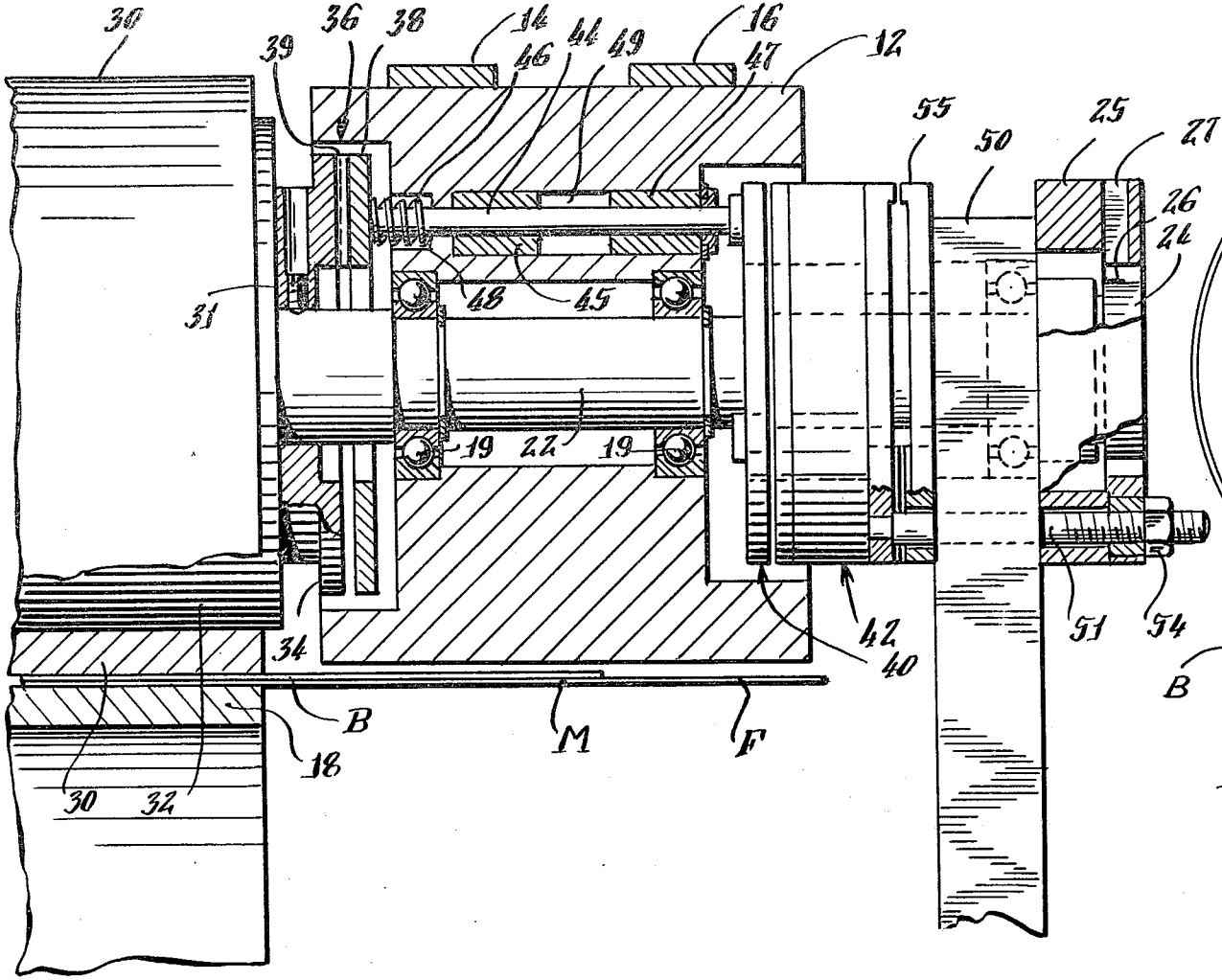
FIG. 3 is a cross-sectional view taken substantially along the plane indicated by line 3—3 of FIG. 2.

In operation, upon sensing the leading edge of the envelope blank B by sensing head 20, and upon sensing index mark 26 on cam 24 in the twelve o'clock position, a signal is sent to the electric brake assembly 42 and the brake is deenergized. Spring 46 pushes the armature assembly 40 and arm 44 away from the brake and causes the clutch plates 34 and 38 to become engaged by shifting second clutch plate 38 to the left as illustrated in FIG. 3, causing the tooth to engage between the clutch plates in the clutch mechanism 36. Thus, as gripper belt 30 and gripper belt pulley 32 continue to rotate, the gummer cylinder 12 (and gummer pads 14, 16), connected to the second clutch plate 38 will rotate upon rotation of shaft 22 to cause the gummer pads to contact envelope blank B.

In the event the sensing head 20 fails to sense an envelope blank B on the feed belt 18, it will be seen that the brake assembly 42 will be activated upon sensing index mark 26 alone, to cause retraction of arm 44 and disengagement of the clutch plates 34 and 38 so the gummer cylinder cannot rotate. Armature ssembly 40 of the brake assembly 42 will stop the cylinder 12 with the gummer pads 14 and 16 in their twelve o'clock position. However, once an envelope blank B is again sensed, the brake assembly 42 is again deactivated allowing the clutch plates to reengage and the motion of pulley 32 to be transmitted to the gummer cylinder 12 to rotate the same. This state will continue until the absence of a blank B on belt 18 is again sensed.

What is claimed is:

1. In an envelope forming apparatus, means for applying gum to spaced locations on an envelope blank comprising;

a gummer cylinder for applying gum to an envelope blank, arcuate, spaced gummer pads for contact with an envelope blank extending along the circumference of said gummer cylinder, means for drivingly rotating said cylinder, means for feeding an envelope blank beneath said gummer cylinder, means for sensing an envelope blank on said feed means, and means for disconnecting said drive means from said cylinder and simultaneously stopping the rotation of said cylinder with the said spaced gummer pads in the twelve o'clock position in response to the failure of said sensing means to sense said envelope blank.

2. In an envelope forming apparatus in accordance with claim 1 said disconnecting means including a clutch and brake assembly between said drive means and gummer cylinder.

3. In an envelope forming apparatus in accordance with claim 2, said clutch and brake assembly including:

a first clutch plate connected to said drive means, a second clutch plate adapted to engage and rotate with said first clutch plate, and an armature assembly drivingly connected to said gummer cylinder, said armature assembly having solenoid arm means fixed to said second clutch plate and gummer cylinder for moving said second clutch plate out of engagement with said first clutch plate in response to sensing the absence of an envelope blank on said feed means.

4. In an envelope forming apparatus in accordance with claim 3 including spring means on said solenoid arm means for normally urging said second clutch plate into engagement with said first clutch plate.

5. In an envelope forming apparatus in accordance with claim 1 further including means for sensing the angular position of said gummer pads on said gummer cylinder and said disconnecting means being rendered inoperable only in response to a signal generated by both said means for sensing an envelope blank on said feed means and said means for sensing the angular position of said gummer pads.

6. In an envelope forming apparatus in accordance with claim 5, said means for sensing the angular position of said gummer pads including cam means drivingly connected to said drive means, and indexing means on said cam means.

7. In an envelope forming apparatus in accordance with claim 6 said disconnecting means including a clutch and brake assembly between said drive means and gummer cylinder.

8. In an envelope forming apparatus in accordance with claim 7, said clutch and brake assembly including a first clutch plate connected to said drive means, a second clutch plate adapted to engage and rotate with said first clutch plate, and an armature assembly drivingly connected to said gummer cylinder, said armature assembly having solenoid arm means fixed to said second clutch plate and gummer cylinder for moving said second clutch plate out of enagement with said first clutch plate in response to sensing the absence of an envelope blank on said feed means.

9. In an envelope forming apparatus in accordance with claim 8 including spring means on said solenoid arm means for normally urging said second clutch plate into engagement with said first clutch plate.

10. In an envelope forming apparatus in accordance with claim 9 wherein said solenoid arm means is mounted on a first armature disc and said clutch and brake assembly includes a stationary second disc having friction generating material thereon facing said first disc for contact with said first disc upon movement of said second clutch plate out of engagement with said first clutch plate in response to sensing the absence of an envelope blank on said feed means.

11. In an envelope forming apparatus in accordance with claim 4 wherein said solenoid arm means is mounted on a first armature disc and said clutch and brake assembly includes a stationary second disc having friction generating material thereon facing said first disc for contact with said first disc upon movement of said second clutch plate out of engagement with said first clutch plate in response to sensing the absence of an envelope blank on said feed means.

* * * * *